US007489897B2

(12) United States Patent
Nakamura et al.

(10) Patent No.: US 7,489,897 B2
(45) Date of Patent: Feb. 10, 2009

(54) RECORDING MEDIUM OUTPUT APPARATUS AND IMAGE FORMING APPARATUS

(75) Inventors: Hiroyuki Nakamura, Ebina (JP); Kiminobu Tsutada, Ebina (JP)

(73) Assignee: Fuji Xerox Co., Ltd., Tokyo (JP)

( * ) Notice: Subject to any disclaimer, the term of this patent is extended or adjusted under 35 U.S.C. 154(b) by 497 days.

(21) Appl. No.: 11/137,399

(22) Filed: May 26, 2005

(65) Prior Publication Data

US 2006/0119871 A1 Jun. 8, 2006

(30) Foreign Application Priority Data

Dec. 3, 2004 (JP) ..... 2004-351120

(51) Int. Cl.
*G03G 15/00* (2006.01)
*G03G 21/00* (2006.01)
*B65H 29/00* (2006.01)
*B65H 29/20* (2006.01)

(52) U.S. Cl. ..... 399/405; 399/361; 399/381; 271/278; 271/286; 271/306; 271/176; 271/177

(58) Field of Classification Search ..... *B65H 29/00*
See application file for complete search history.

(56) References Cited

U.S. PATENT DOCUMENTS 4,480,825 A * 11/1984 Landa ..... 271/81
4,635,920 A * 1/1987 Kodama ..... 271/81
6,421,523 B1 * 7/2002 Kondo et al. ..... 399/404
6,886,828 B2 * 5/2005 Saito ..... 271/225
7,162,195 B2 * 1/2007 Matsuyama et al. ..... 399/404

FOREIGN PATENT DOCUMENTS

| | | | |
|---|---|---|---|
| JP | 61075768 A | * | 4/1986 |
| JP | 62-249858 | | 10/1987 |
| JP | 1-214565 | | 8/1989 |
| JP | 04112158 A | * | 4/1992 |
| JP | 8-208091 | | 8/1996 |
| JP | 8-208098 | | 8/1996 |
| JP | 11334975 A | * | 12/1999 |
| JP | 2003104619 A | * | 4/2003 |

* cited by examiner

*Primary Examiner*—Jill E. Culler
*Assistant Examiner*—'Wyn' Q Ha
(74) *Attorney, Agent, or Firm*—Morgan, Lewis & Bockius LLP

(57) ABSTRACT

In a recording medium output apparatus that is assembled to an image forming apparatus and outputs a sheet-like recording medium being transported onto a stack tray on which recording media are stacked, the recording medium output apparatus includes an output unit and a drive unit. The output unit is free to move in a recording medium width direction intersecting the transport direction of the recording medium being transported and outputs the recording medium toward the stack tray at a position higher than that of the stack tray, and the drive unit moves the output unit in the recording medium width direction before and after the trail edge of the recording medium to be output from the output unit leaves the output unit.

17 Claims, 8 Drawing Sheets

RECORDING MEDIUM OUTPUT APPARATUS AND IMAGE FORMING APPARATUS

BACKGROUND OF THE INVENTION

1. Field of the Invention

The present invention relates to a recording medium output apparatus for outputting a sheet-like recording medium being transported onto a stack tray on which recording media are stacked and to an image forming apparatus provided with the recording medium output apparatus.

2. Description of the Related Art

A recording medium output apparatus is assembled to an image forming apparatus such as a copy machine, a facsimile, a printer, and the like using an electrophotographic system to output a sheet-like recording medium (for example, a sheet and the like). There is a recording medium output apparatus provided with an output unit movable in a sheet width direction so that, when plural sets of copies are made from plural documents, the sets of copies can be easily sorted by being output after the copies of each set are offset in a sheet width direction perpendicular to the transport direction thereof. In the recording medium output apparatus having the output unit movable in the sheet width direction, the output unit begins to move after the lead edge of a sheet leaves the output unit. The sheet is continuously output while the output unit is being moved, and the trail edge of the sheet leaves the output unit after the output unit stops at a predetermined offset position.

However, since the output unit, which moved until that time, stops, a force, which acts in a direction opposite to the moving direction of the output unit, acts on the trail edge of the sheet just before the trail edge of the sheet leaves the output unit, whereas an inertia force, which is generated by the movement of the output unit and acts in the moving direction of the output unit, acts on the lead edge of the sheet. Accordingly, a turning force acts on the sheet just after the trail edge thereof leaves the output unit so as to direct the lead edge of the sheet in the moving direction and the trail edge thereof in the direction opposite to the moving direction. Although the sheet output from the output unit falls onto a stack tray on which sheets are stacked, the attitude of the sheet fallen onto the tray may be disturbed by the turning force. When sheets are disturbed on the stack tray, the boundaries among respective sets of sheets become obscure or an amount of offset is reduced due to the disturbance of the attitude of the sheets, which makes sorting difficult.

By the way, the amount of offset in the sheet width direction is determined by the size (machine size) of an image forming apparatus to which the recording medium output apparatus is assembled. Accordingly, when it is intended to increase the amount of offset to execute sorting more easily even if slightly, the machine size must be increased, which prevents the reduction of the size and the cost of the image forming apparatus. To cope with the above problem, there are proposals for suppressing the dispersed attitudes of sheets to execute sorting more easily even if slightly without increasing the amount of offset (refer to for example, Japanese Patent Application Laid-Open Publications Nos. 8-208098, 8-208091, 1-214565, and 62-249858). These proposals intend to improve the alignment of sheets by guiding the trail edges of the sheets output from an output unit, by guiding the trail edges of the sheets before and after they are output from the output unit, or by devising the shape of the output unit. Therefore, it is contemplated to combine the recording medium output apparatus, in which the turning force acts on a sheet just after it is output, with these proposals.

However, it is desired to increase the amount of offset to execute sorting more easily.

The present invention has been made in view of the above circumstances and provides a recording medium output apparatus, in which an amount of offset is increased without increasing a machine size as well as a sheet alignment capability is enhanced, and an image forming apparatus provided with the recording medium output apparatus.

SUMMARY OF THE INVENTION

The present invention has been made in view of the above circumstances and provides a recording medium output apparatus and image forming apparatus. A recording medium output apparatus according to the present invention outputs a sheet-like recording medium being transported onto a stack tray on which recording media are stacked, and the apparatus includes: an output unit that is free to move in a recording medium width direction intersecting the transport direction of the recording medium being transported and outputs the recording medium toward the stack tray at a position higher than the stack tray; and a drive unit that moves the output unit in the recording medium width direction before and after the trail edge of the recording medium, which is to be output from the output unit, leaves the output unit.

According to the recording medium output apparatus of the present invention, since the drive unit moves the output unit in the recording medium width direction before and after the trail edge of the recording medium leaves the output unit, a force, which tends to fly the recording medium obliquely forward, acts thereon just after the trail edge of the recording medium leaves the output unit. That is, since the force, which tends to move the recording medium in the recording medium width direction acts thereon even after it leaves the output unit, an amount of offset can be increased by the force without increasing a machine size. Further, since the recording medium is output while the output unit is being moved, a force as the turning force described above, which disturbs the attitude of a sheet, does not act on the recording medium having been output from the output unit, thereby a sheet alignment capability can be enhanced.

According to the recording medium output apparatus of the present invention, the force, which acts on the recording medium after it leaves the output unit and tends to move it in the recording medium width direction, can be adjusted by adjusting the moving distance of the output unit from the time at which the output unit begins to move to the time at which the trail edge of the recording medium leaves output unit and adjusting the moving speed of the output unit. The trail edge of the recording medium may leave the output unit at any timing at which the output unit is being accelerated, reaches a maximum speed, or is being decelerated.

According to the present invention, there can be provided the recording medium output apparatus, which can increase the amount of offset without increasing the machine size and can enhance the sheet alignment capability, and an image forming apparatus provided with the recording medium output apparatus.

BRIEF DESCRIPTION OF THE DRAWINGS

An embodiment of the present invention will be described below in detail based on the following figures, wherein.

DETAILED DESCRIPTION OF THE INVENTION

An embodiment of the present invention will be described blow with reference to the drawings.

Figure 1:
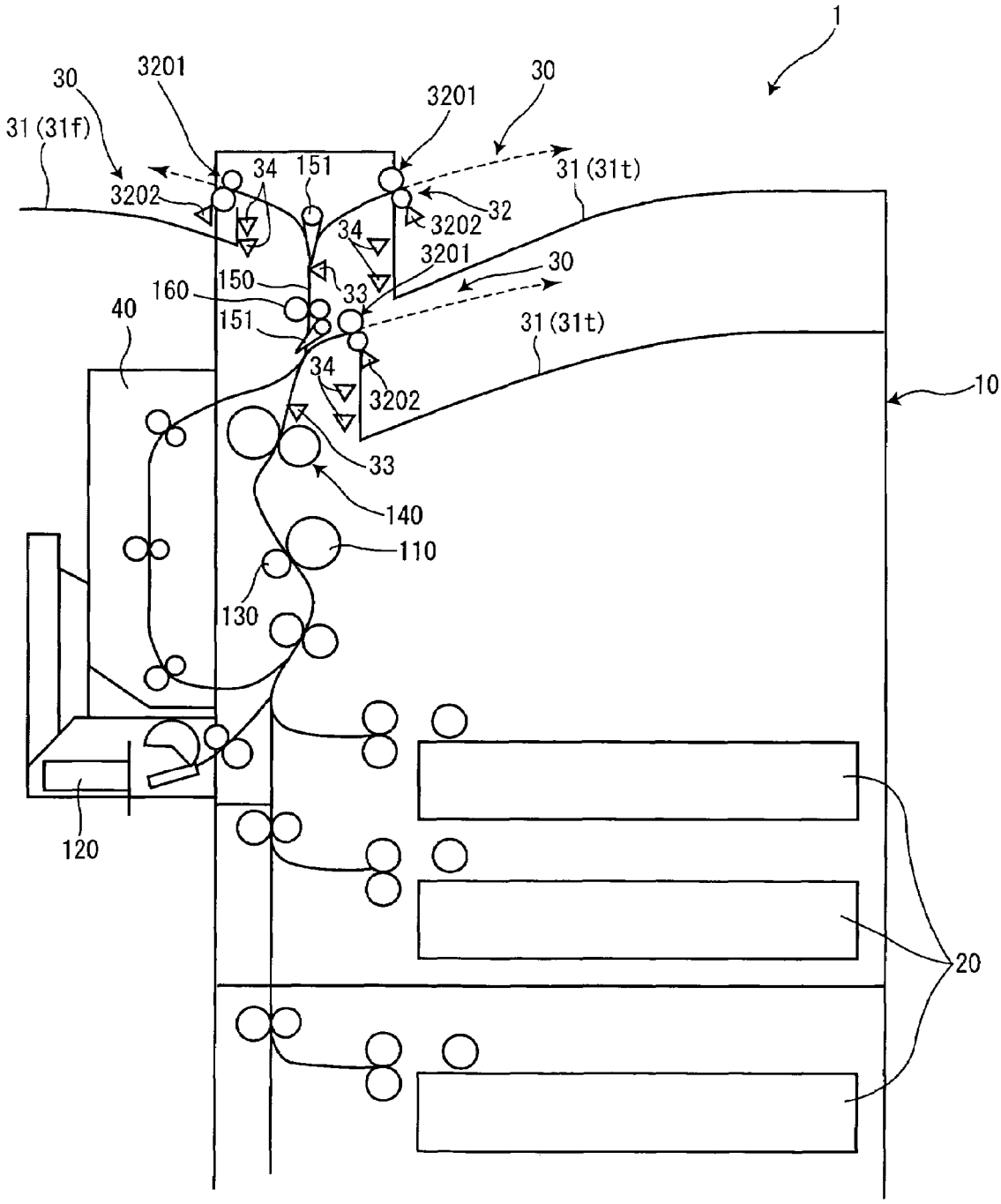
FIG. 1 is a view showing a schematic arrangement of an image forming apparatus to which a sheet output apparatus as an embodiment of a recording medium output apparatus of the present invention is assembled.

FIG. 1 is a view showing the schematic arrangement of an image forming apparatus to which a sheet output apparatus is assembled as an embodiment of a recording medium output apparatus of the present invention.

The image forming apparatus 1 shown in FIG. 1 has an apparatus main body 10 provided with an image carrier 110, and three recording medium cassettes 20 in which sheet-like recording media are accommodated. The three recording medium cassettes 20 shown in FIG. 1 accommodate sheets having a different size and sheets having a different weight per unit area. Sheets such as a B5 size sheet, an A3 size sheet, and the like are exemplified as examples of the sheets having the different size. Further, a plain sheet, a coated sheet, a thick sheet, and further an OHP sheet are exemplified as examples of the sheets having the different weight per unit area. In general, a recording medium has a different weight per unit area depending of a type thereof (type of paper). Further, the image forming apparatus 1 show in FIG. 1 also includes a manual sheet feed unit 120. Recording media having a specific size and a specific type such as a post card and the like are set to the manual sheet feed unit 120. The size and the type of a recording medium on which an image is formed is designated by an operator through a not shown manipulation panel.

The image carrier 110 shown in FIG. 1 rotates in a predetermined direction and is formed in a drum shape, and FIG. 1 shows a transfer roller 130 disposed to rotate in contact with the surface of the image carrier 110. In the image forming apparatus 1 shown in FIG. 1, the region in which the image carrier 110 is in contact with the transfer roller 130 forms a transfer region. A recording medium, which is accommodated in the recording medium cassette 20 or fed from the manual sheet feed unit 120, is transferred to the transfer region by various rollers.

Although an electric charger, an exposure unit, a development unit, and the like are disposed around the periphery of the image carrier 110, they are omitted in the figure. After the surface of the drum-shaped image carrier 110 is uniformly charged by the electric charger, it is exposed by the exposure unit, thereby an electrostatic latent image is formed thereon. The electrostatic latent image formed on the image carrier 110 is developed by the development unit and made to a toner image. The toner image is sent to the transfer region and transferred onto the recording medium. Further, the image forming apparatus 1 shown in FIG. 1 also includes a fixing unit 140, and the recording medium onto which the toner image is transferred is sent to the fixing unit 140, and the toner image is fixed on the recording medium.

The image forming apparatus 1 shown in FIG. 1 includes three sets of sheet output apparatuses 30 each having a stack tray 31, and a recording medium transport path 150 extending from the fixing unit 140 is connected to each of the three sets of the sheet output apparatuses 30. The stack tray 31 is stacked with a recording medium on which an image is formed. The stack tray 31 shown on the right side of FIG. 1 is stacked with a recording medium whose one surface (printed surface) has an image formed thereon and faces downward. Hereinafter, this stack tray 31 may be called a top tray 31*t*. In contrast, the stack tray 31 shown on the left side of FIG. 1 is stacked with a recording medium whose print surface faces upward, and hereinafter this stack tray 31 may be called a face-up tray 31*f*.

Further, the image forming apparatus 1 shown in FIG. 1 also includes a sheet reversing unit 40 used when an image is formed on both the surfaces of a sheet-like recording medium, and the recording medium transport path 150 has a route branching to the sheet reversing unit 40. Further, the recording medium transport path 150 also includes a transport roller pair 160 and a distribution mechanism 151. The transport roller pair 160 transports the recording medium sent from the fixing unit 140 toward output rollers 3201, and the distribution mechanism 151 distributes a recording medium to one of the three sheet output apparatuses 30.

The three sheet output apparatuses 30 shown in FIG. 1 have the same arrangement, and each of them includes an output unit 32. The output unit 32 outputs a recording medium toward the stack tray 31. The output unit 32 is disposed at a position higher than the height position at which the stack tray 31 is disposed, and the recording medium output from the output unit 32 falls onto the stack tray 31. The stack tray 31 gradually inclines downward toward the output unit 32, and the recording medium fallen onto the stack tray 31 slidingly falls along the slope of the stack tray 31. The output unit 32 shown in FIG. 1 includes the output rollers 3201 and an offset position sensor 3202. Further, each of the sheet output apparatuses 30 shown in FIG. 1 also includes trail edge sensors 33 and height position sensors 34. Two sets of the trail edge sensors 33 are disposed in the recording medium transport path 150, and when a recording medium is transported to the sheet output apparatus 30 disposed on the uppermost stream side of the three sheet output apparatuses 30, the trail edge sensor 33 disposed on the upper stream side when viewed from the transport direction of the recording medium detects that the trail edge of the recording medium being transported passes therethrough. Whereas, when a recording medium is transported to the remaining two sheet output apparatuses 30, the trail edge sensor 33 on the lower stream side detects that the trail edge of the recording medium being transported passes therethrough. Two sets of the height position sensors 34 are disposed to each of the stack trays 31 at different height positions so that they detect the height position of the uppermost recording medium on the stack tray 31 at two positions. Note that the height position sensor 34 shown in FIG. 1 may be replaced with a linear sensor so that the height position of the uppermost recording medium on the stack tray 31 can be continuously detected.

Figure 2:
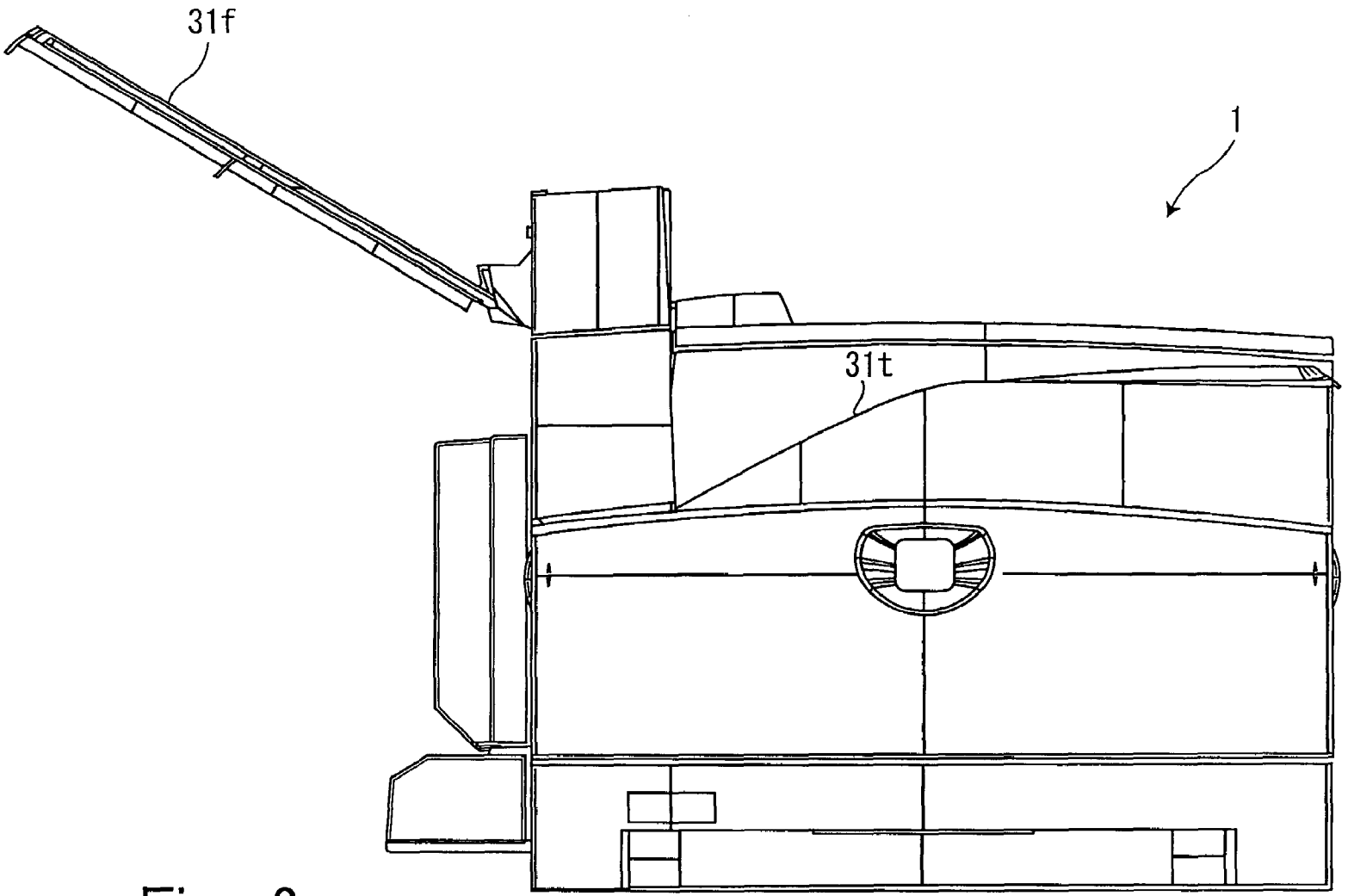
FIG. 2 is an outside appearance view of the image forming apparatus shown in FIG. 1 when it is viewed from the front surface thereof facing an operator during use.
Figure 3:
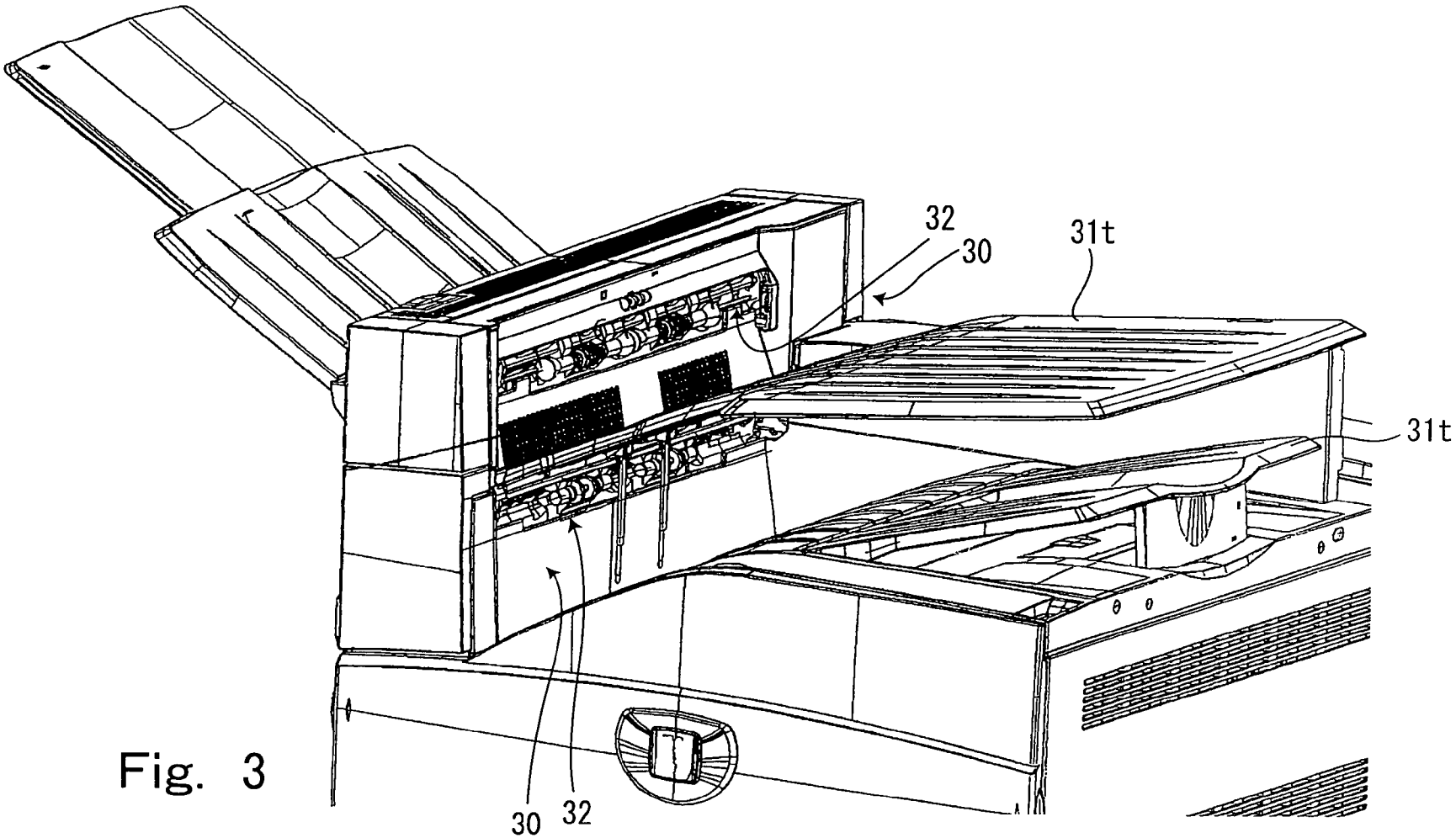
FIG. 3 is a perspective view of the image forming apparatus shown in FIG. 1 when the outside appearance of the portion thereof, to which the sheet output apparatus is assembled, is viewed from obliquely upward of a top tray side.
Figure 4:
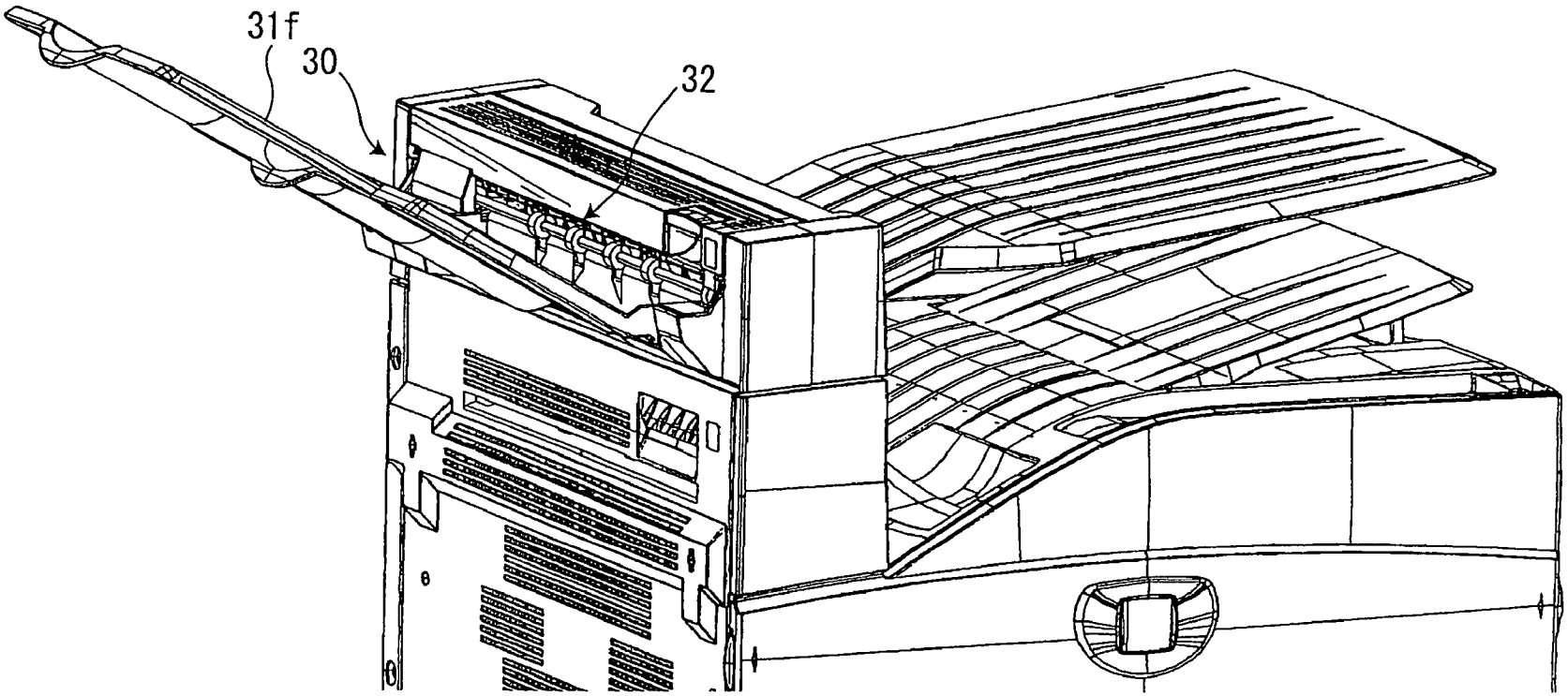
FIG. 4 is a perspective view of the image forming apparatus shown in FIG. 1 when the outside appearance of the portion thereof to which the sheet output apparatus is assembled is viewed from obliquely upward of a face-up tray side.

FIG. 2 is an outside appearance view of the image forming apparatus shown in FIG. 1 when it is viewed from the front surface thereof facing the operator during use (only one top tray 31*t* is shown). FIG. 3 is a perspective view of the image forming apparatus shown in FIG. 1 when the outside appearance of the portion thereof, to which the sheet output apparatus is assembled, is viewed from obliquely upward of the top tray side. FIG. 4 is a perspective view of the same portion viewed from obliquely upward of the face-up tray.

FIG. 2 shows the face-up tray 31*f* on the left side and the top tray 31*t* on the right side (the top tray 31*t* on the upper stage is not shown). Further, FIG. 3 shows the output unit 32 of the sheet output apparatus 30 that outputs a recording medium onto the top tray 31*t*. In contrast, FIG. 4 shows the output unit 32 of the sheet output apparatus 30 that outputs a recording medium onto the face-up tray 31*f*.

Figure 5:
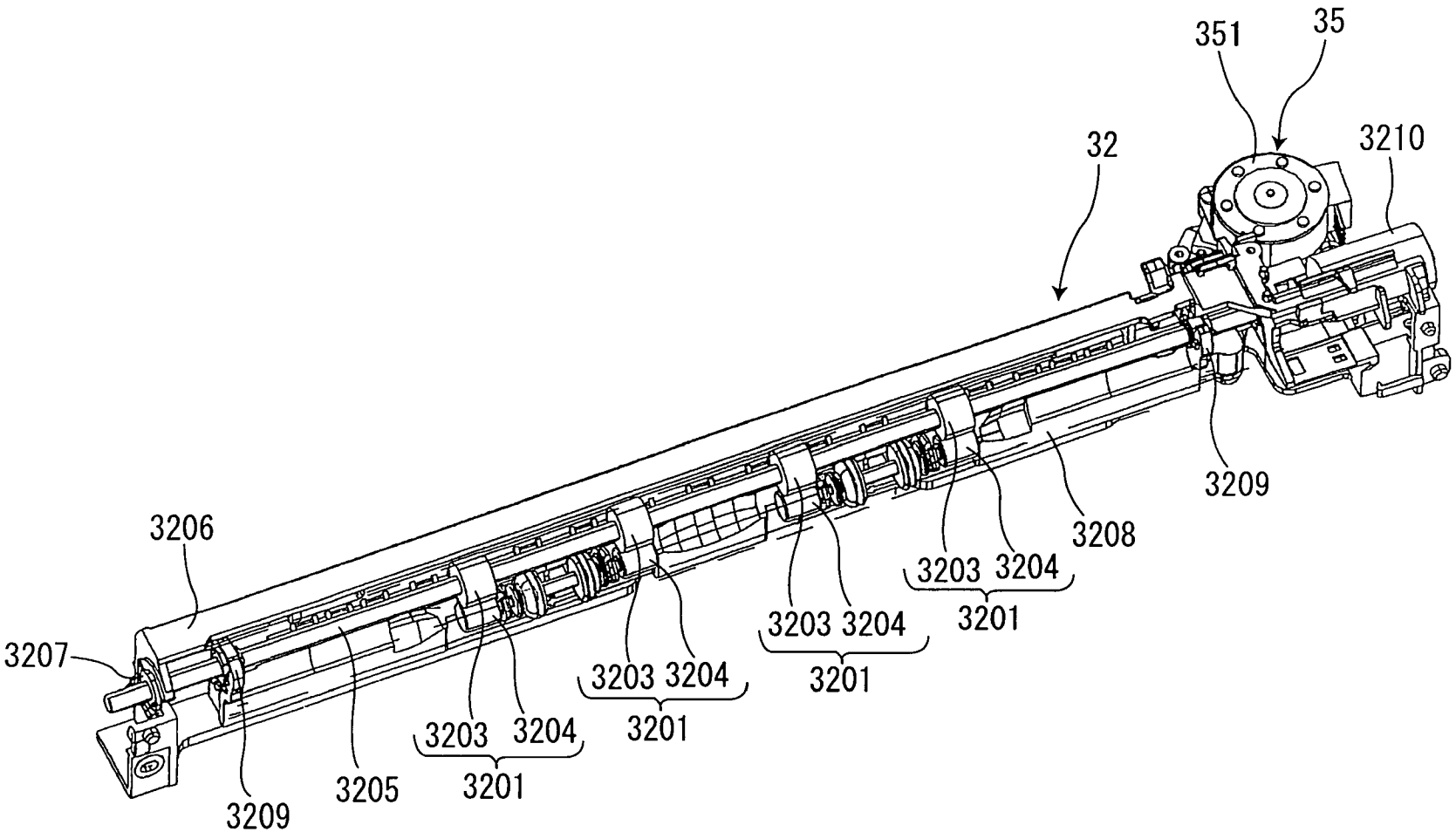
FIG. 5 is a perspective view showing an output unit shown in FIGS. 3 and 4 when it is taken out from the sheet output apparatus.

FIG. 5 is a perspective view showing the output unit shown in FIGS. 3 and 4 when it is taken out from the sheet output apparatus.

The output unit 32 shown in FIG. 5 extends in the direction connecting the front surface of the image forming apparatus to the rear surface thereof in the image forming apparatus shown in FIGS. 3 and 4. This direction corresponds to a recording medium width direction perpendicular to the transport direction of a sheet-like recording medium being transported in the recording medium transport path 150 shown in FIG. 1. The output unit 32 has the output rollers 3201 disposed thereto as described above. Each of the output rollers 3201 is composed of a drive roller 3203 rotated by the drive force of a not shown motor and a pinch roller 3204 for forming a nip region between it and the drive roller 3203, and FIG. 5 shows four sets of the output rollers 3201 disposed at predetermined intervals. The drive rollers 3203 are fixed to a rotation shaft 3205, and an end of the rotation shaft 3205 is supported by a fixing side chute 3206 through a bearing 3207. Although the fixing side chute 3206 is fixed to the frame (not shown) of the sheet output apparatuses 30, the output unit 32 has a movable side chute 3208 that is free to move to the fixing side chute 3206 in the direction in which the rotation shaft 3205 extends (recording sheet width direction).

Figure 6:
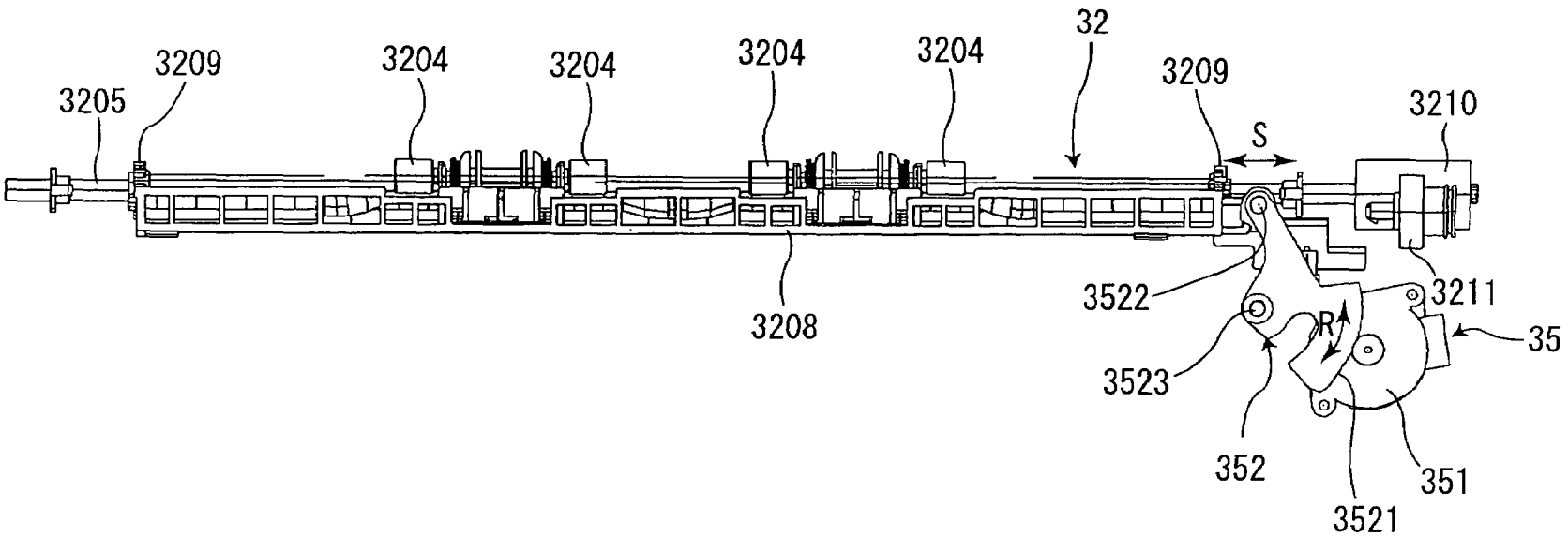
FIG. 6 is a view showing the output unit shown in FIG. 5 when it is viewed from a pinch roller side by removing a fixing side chute therefrom.

FIG. 6 is a view showing the output unit shown in FIG. 5 viewed from the pinch roller side by removing the fixing side chute therefrom;

FIG. 6 shows the movable side chute 3208 extending in the extending direction of the rotation shaft 3205 (right to left direction in FIG. 6). The rotation shaft 3205 passes through both the ends of the movable side chute 3028 in the extending direction of the rotation shaft 3205 (recording medium width direction), respectively, and bearings 3209 are disposed to both the ends of the movable side chute 3208. The rotation shaft 3205 is free to move in the recording medium width direction together with the movable side chute 3208, and thus the drive rollers 3203 shown in FIG. 5 are also free to move in the recording medium width direction together with the movable side chute 3208. Further, the pinch rollers 3204 are also rotatably journaled by the movable side chute 3208 and free to move in the recording medium width direction together with the movable side chute 3208. Accordingly, when the movable side chute 3208 moves in the recording medium width direction, the output rollers 3201 also move in the recording medium width direction together with the movable side chute 3208 while keeping the nip regions.

The lead edge of a recording medium being transported through the recording medium transport path 150 shown in FIG. 1 enters the nip regions of the output rollers 3201. At the time the lead edge of the recording medium enters the nip regions, the movable side chute 3208 is located at the position (hereinafter referred to as a home position) at which the central portion of the lead edge of the recording medium in the width direction thereof is in coincidence with the exact intermediate position of the output rollers 3201 adjacent with each other at intervals at the central portion of the rotation shaft.

When plural sets of plural documents are copied, the sheet output apparatuses 30 of the embodiment have an offset function for offsetting the recording media of each set in the recording medium width direction before they are output onto the stack tray 31 so that they can be easily sorted. To realize the offset function, the movable side chute 3208 located at the home position is moved in the recording medium width direction. Each of the sheet output apparatuses 30 of the embodiment also includes a drive unit 35 for moving the movable side chute 3208 in the recording medium width direction. The drive unit 35 includes a stepping motor 351 and a sector gear 352 (refer to FIG. 6). The fan-shaped portion 3521 of the sector gear 352 is meshed with the rotation shaft of the stepping motor 351, and the extreme end portion 3522 of the sector gear 352 is connected to the movable side chute 3208. When the stepping motor 351 is rotated, the sector gear 352 is turned about a gear turning fulcrum 3523 (refer to an arrow R in FIG. 6), thereby the movable side chute 3208 moves in the recording medium width direction (refer to an arrow S in FIG. 6).

The end of the rotation shaft 3205 shown in FIG. 6 opposite to the end thereof supported by the fixing side chute through the bearing 3207 has an axially long drive gear 3210 attached thereto outside of a similar bearing 3207 (not shown). The drive gear 3210 is meshed with a transmission gear 3211 for transmitting the drive force of a not shown motor. When the movable side chute 3208 is moved in the recording medium width direction by the drive unit 35, the drive gear 3210 is also moved in the recording medium width direction. For this purpose, the drive gear 3210 is formed long in the extending direction of the rotation shaft 3205 (recording medium width direction) so that it is kept meshed with the transmission gear 3211 even if it is moved in the recording medium width direction.

Subsequently, the operation of the drive unit 35 will be described in detail.

First, when the lead edge of a recording medium passes through the fixing unit 140 shown in FIG. 1, the drive rollers 3203 shown in FIG. 5 begins to be driven, and then when the trail edge of the recording medium passes through the trail edge sensor 33, the drive unit 35 begins to count a time. At the time, when the movable side chute 3208 is located at a position other than the home position, it is moved to the home position by the drive unit 35. When the movable side chute 3208 approaches the home position, the offset position sensor 3202 shown in FIG. 1 detects the movable side chute 3208 approaching the home position, and the stepping motor 351, which is pulse controlled, stops the movable side chute 3208 at the home position.

Presently, the lead edge of the recording medium reaches the nip regions of the output rollers 3201, is drawn into the nip regions by the drive rollers 3203, and passes through the nip regions. Thereafter, the stepping motor 351 begins to rotate, and the movable side chute 3208 begins to move in the recording medium width direction.

Figure 7:
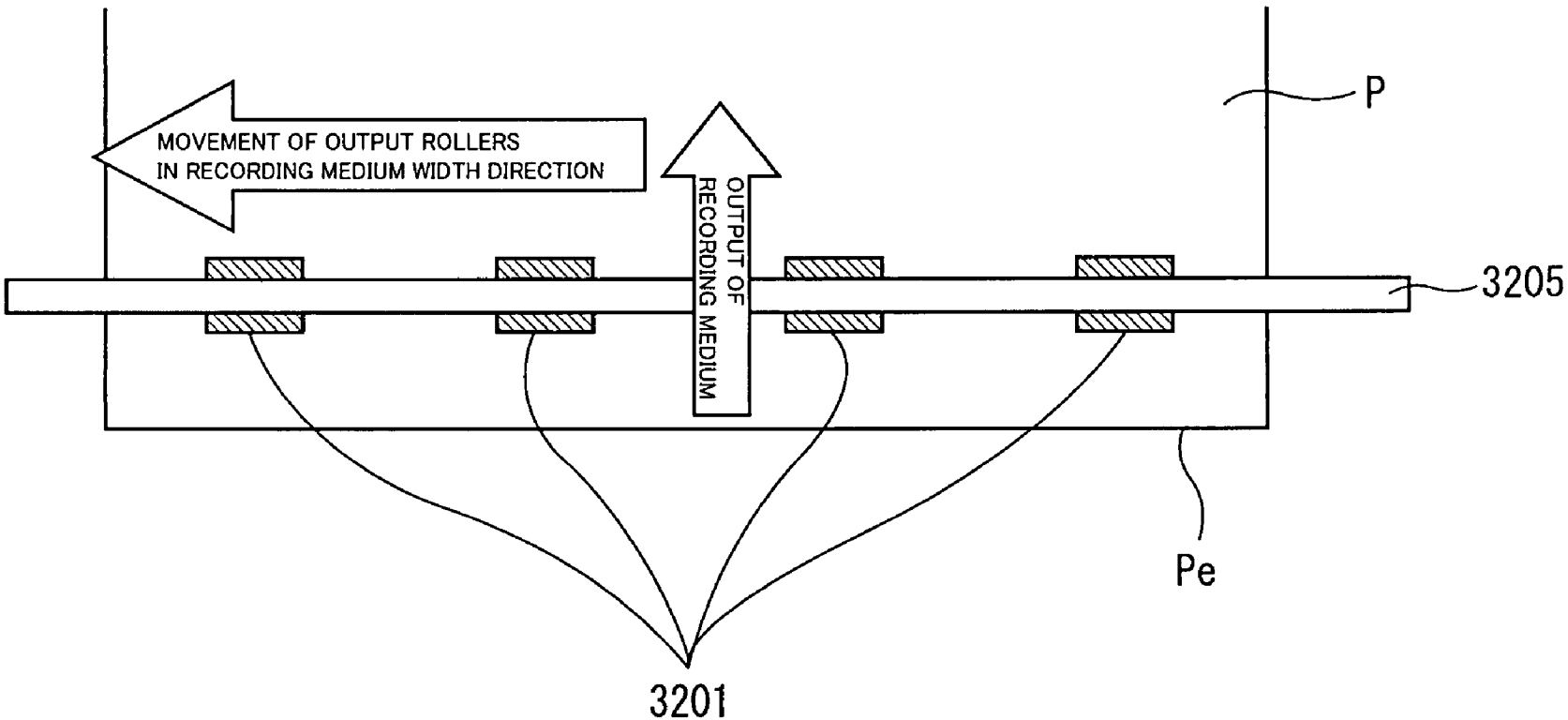
FIG. 7 is a view showing how output rollers, which are outputting a recording medium nipped in nip regions, move in a recording medium width direction.

FIG. 7 is a view showing how the output rollers 3201, which are outputting the recording medium nipped in the nip regions, move in the recording medium width direction.

When the movable side chute 3208 moves, the output rollers 3201 move in the recording medium width direction (left direction in FIG. 7) while nipping the recording medium P in the nip regions. At the time, the drive rollers 3203 continues rotation, thereby the recording medium p is continuously output. In FIG. 7, the recording medium P is output upward.

Thereafter, the trail edge Pe of the recording medium P leaves the nip regions of the output rollers 3201. The stepping motor 351 continues rotation before and after the trail edge Pe of the recording medium P leaves the nip regions, and the output rollers 3201 move in the recording medium width direction before and after the trail edge Pe of the recording medium P leaves the nip regions. Accordingly, an obliquely left upward force acts on the recording medium P just after the trail edge Pe thereof leaves nip regions in FIG. 7, thereby the recording medium P tends to fly obliquely upward until it falls onto the stack tray 31. That is, a force, which tends to move in the recording medium width direction, acts on the recording medium P even after it leaves the output rollers 3201, thereby the amount of offset is increased by the force without increasing the machine size. Further, since the recording medium P is output while the output rollers 3201 are moving, forces whose directions are diametrically opposite to each other do not act on the lead edge and the trail edge of the recording medium P having left the output rollers 3201, thereby a sheet alignment capability is enhanced.

After the trail edge Pe of the recording medium P leaves the nip regions, the stepping motor 351 stops its rotation, thereby the rotation of the output rollers 3201 is finished.

The timing at which the stepping motor 351 begins to rotate, that is, the timing at which the output rollers 3201 begin to move is managed by a threshold value set to the drive unit 35. The threshold value is a value relating to the time counted by the drive unit 35, and when a time count value exceeds the threshold value, the stepping motor 351 begins to rotate, and the output rollers 3201 begin to move. The threshold value is set to a value according to a time after the lead edge of the recording medium passes through the output rollers 3201. Further, the threshold value is a value set to each of a height position as a result of detection of the height position of the uppermost recording medium on the stack tray 31 executed by the height position sensor 34, the size of a recording medium, and the kind of a recording medium (kind of paper), that is, the weight per unit area of the recording medium. The higher is the height position of the uppermost recording medium on the stack tray 31, the shorter is the falling distance of the recording medium to the stack tray 31, and the shorter the falling distance, the more the recording medium output from the output rollers 3201 is unlike to fly obliquely forward. Further, the smaller the size of the recording medium is, the more the recording medium output from the output rollers 3201 is unlike to fly obliquely forward. Further, the heavier is the weight per unit area of the recording medium, the more the recording medium output from the output rollers 3201 is unlike to fly obliquely forward. In contrast, the longer is the moving distance of the output rollers 3201 from the time at which it begins to move to the time at which the trail edge of the recording medium leaves the output rollers 3201, the more the recording medium output from output rollers 3201 is liable to fly obliquely forward.

Thus, to permit even a recording medium having a short falling distance to be liable to fly obliquely forward, there are prepared three kinds of threshold values as to the height position of the uppermost recording medium on the stack tray 31. After the height position of the uppermost recording medium of the recording media continuously stacked on the stack tray 31 reaches the position at which the upper height position sensor 34 of the two upper and lower height position sensors 34 shown in FIG. 1 is disposed, the drive unit 35 sets a long moving distance by employing a smallest threshold value so that even the recording medium having the short falling distance is liable to fly obliquely forward to thereby secure a sufficient amount of offset. Note that when the height position of the uppermost recording medium is lower than the position at which the lower height position sensor 34 is disposed, the drive unit 35 sets a shortest moving distance by employing a largest threshold value, and after the uppermost recording medium reaches the position at which the lower height position sensor 34 is disposed, the drive unit 35 employs an intermediate threshold value until the uppermost recording medium reaches the position at which the upper height position sensor 34 is disposed. That is, when the drive unit 35 moves the output rollers 3201 in the recording medium width direction, the higher is the height position of the uppermost recording medium as a result of detection executed by the height position sensors 34, the longer distance the drive unit 35 moves the output rollers 3201.

Further, plural threshold values are prepared according to the sizes of recording media so that the smaller the size of a recording medium is, the more it is liable to fly obliquely forward. When the operator manipulates the not shown manipulation panel, the size of a recording medium on which an image is formed is transmitted to the drive unit 35. When, for example, an image is formed on a relatively small B5 size recording medium, the drive unit 35 sets a long moving distance by employing a small threshold value to thereby secure a sufficient amount of offset by causing the recording medium to liable to fly obliquely forward even if it has the small size, and when an image is formed on a relatively large A3 size recording medium, the drive unit 35 employs a threshold value larger than that used in B5 size. That is, when the drive unit 35 moves the output rollers 3201 in the recording medium width direction, it moves the output rollers 3201 so that they move a longer distance when a recording medium has a smaller size. With this operation, even if sets of recording media, in which each of the sets includes recording media having a different size, are output, the sheet alignment capability can be enhanced.

Further, to cause a recording medium having a larger weight per unit area to be liable to fly obliquely forward, there are prepared plural threshold values according to plural types of recording media. When the operator manipulates the not shown manipulation panel, the type of a recording medium on which an image is recorded is also transmitted to the drive unit 35. When, for example, an image is formed on a recording medium composed of a thick paper having a relatively large weight per unit area, the drive unit 35 sets a long moving distance by employing a small threshold value to thereby secure a sufficient amount of offset by causing the recording medium to be liable to fly obliquely forward even if it has the large weight. Whereas, when an image is formed on a recording medium composed a plain sheet having a relatively light weight per unit area, the drive unit 35 employs a threshold value larger than that used in the thick sheet. That is, when the drive unit 35 moves the output rollers 3201 in the recording medium width direction, it moves the output rollers 3201 so that they move a longer distance when a recording medium has a larger weight per unit area. With this operation, even if sets of recording media, in which each of the sets includes recording media having a different weight per unit area, are output, the sheet alignment capability can be enhanced.

Further, the higher is the moving speed of the output rollers 3201, the more the recording medium output therefrom is liable to fly obliquely forward. Accordingly, when the uppermost recording medium has a higher height position as a result of detection executed by the height position sensors 34, the drive 35 unit moves the output rollers 3201 at a faster speed in the recording medium width direction, when a recording medium has a smaller size, the drive unit 35 moves the output rollers 3201 at a faster speed, and when a recording medium has a larger weight per unit area, the drive unit moves the output rollers 3201 at a faster speed. With the above operation, a sufficient amount of offset can be also secured, thereby the sheet alignment capability can be enhanced.

Note that the above operations of the drive unit 35 executed when a recording medium has a different size or a different weight per unit area are only examples. That is, according to the present invention, the drive unit 35 may move the output rollers 3201 in the recording medium width direction a different distance or at a different moving speed according to the size of a recording medium. Further, the drive unit 35 may move the output rollers 3201 a different distance or at a different moving speed according to the weight per unit area of a recording medium. Further, according to the present invention, the method of detecting the height position of the uppermost recording medium on the stack tray 31 is not limited to the method of using the sensor. The amount of offset can be increased even in a recording medium whose falling distance is reduced by determining the height position of the uppermost recording medium based on the number of continuously output recording media.

Figure 8:
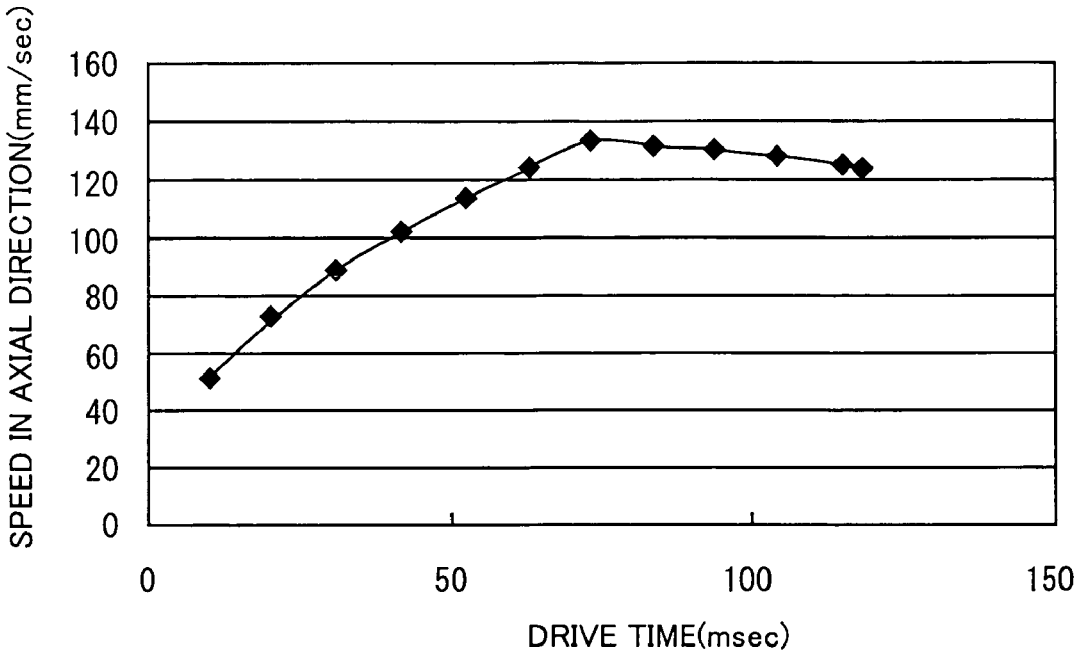
FIG. 8 is a graph showing the relation between the drive time of a stepping motor shown in FIG. 5 and the moving speed of the output rollers.

FIG. 8 is a graph showing the relation between the drive time of the stepping motor shown in FIG. 5 and the moving speed of the output rollers.

The lateral axis of the graph shown in FIG. 8 shows the time passed after the stepping motor 351 begins to be driven (driven time (msec)), and the vertical axis thereof shows the moving speed of output rollers (mm/sec). Since the sector gear 352 meshed with the stepping motor 351 has the shape as shown in FIG. 6, the rotating speed of the stepping motor 351 is not linearly reflected to the moving speed of the output rollers 3201. That is, the moving speed of the output rollers is maximized when the extreme end portion 3522 of the sector gear 352 is vertically connected to the movable side chute 3028. The trail edge of a recording medium may leave the output rollers 3201 at any timing at which they are being accelerated, reach a maximum speed, or are being decelerated, and the timing may be determined based on the amount of a force which is applied, just after the trail edge of the recording medium leaves the output rollers 3201, to the recording medium so as to move in the recording medium width direction. According to the sheet output apparatus 30 of the embodiment, the force, which acts on the recording medium just after it leaves the output rollers 3201 and tends to move in the recording medium width direction, can be adjusted by adjusting the moving speed of the output rollers 3201, thereby the amount of offset can be adjusted. Further, the force, which tends to act on the recording medium just after it leaves the output rollers 3201 and tends to move in the recording medium width direction, can be also adjusted by adjusting the moving distance of the output rollers 3201 from the time at which they begin to move to the time at which the trail edge of a recording medium leaves the output rollers 3201, thereby the amount of offset can be adjusted.

As described above, according to the sheet output apparatus 30 of the embodiment, the amount of offset can be increased without increasing the machine size as well as the sheet alignment capability can be enhanced. As an example, the image forming apparatus 1 to which the sheet output apparatus 30 of the embodiment is assembled can increase the amount of offset at least approximately 1.5 times that of an image forming apparatus to which a conventional sheet output apparatus is assembled in which the trail edge of a recording medium leaves output rollers after they stop, despite the fact that the machine size of the image forming apparatus 1 is the same as that of the image forming apparatus to which the conventional sheet output apparatus is assembled.

In the recording medium output apparatus according to the present invention, while the drive unit is moving the output unit in the recording medium width direction, the trail edge of the recording medium nipped by the output unit may be a free end.

In addition, the recording medium output apparatus according to the present invention may include a trail edge sensor that detects that the trail edge of the recording medium being transported to the output unit has passed, in which the drive unit may begin to move the output unit after a predetermined time passes in response to detection of the passing of the trail edge of the recording medium by the trail edge sensor.

With this operation, the timing at which the output unit is caused to begin to move by the drive unit can be accurately controlled, thereby the moving distance of the output unit from the time at which the output unit begins to move to the time at which the trail edge of the recording medium leaves the output unit can be correctly controlled.

Further, in the recording medium output apparatus according to the present invention, it is acceptable that the output unit outputs a sheet-like recording medium having a different size; and when the drive unit moves the output unit in the recording medium width direction, the smaller the size of the recording medium is, the longer distance the drive unit moves the output unit from the time at which the drive unit begins to move the output unit to the time at which the trail edge of the recording medium leaves the output unit. Alternatively, it is acceptable that, when the drive unit moves the output unit in the recording medium width direction, the smaller the size of the recording medium is, at the higher speed the drive unit moves the output unit.

According to the present invention, the smaller the size of the recording medium is, the more the recording medium output from the output unit is unlike to fly obliquely forward. In contrast, the longer the movement distance is or the faster the moving speed is, the more the recording medium output from the output unit is liable to fly obliquely forward. Accordingly, the amount of offset can be increased even in a recording medium having a small size by making the recording medium having the smaller size to be liable to more fly obliquely forward. As a result, even if sets of recording media, in which recording media having a different size are mixed, are output, the sheet alignment capability can be enhanced.

Still further, in the recording medium output apparatus according to the present invention, it is also acceptable that the output unit outputs a sheet-like recording medium having a different weight per unit area; and when the drive unit moves the output unit in the recording medium width direction, the larger the weight per unit area of the recording medium is, the longer distance the drive unit moves the output unit from the time at which the drive unit begins to move the output unit to the time at which the trail edge of the recording medium leaves the output unit. Alternatively, it is acceptable that, when the drive unit moves the output unit in the recording medium width direction, the larger the weight per unit area of the recording medium is, at the higher speed the drive unit moves the output unit.

According to the present invention, the larger the weigh per unit area of the recording medium is, the more the recording medium output from the output unit is unlike to fly obliquely forward. Accordingly, the amount of offset can be increased even in a recording medium having a large weigh per unit area by making the recording medium having the large weight per unit area to be liable to more fly obliquely forward. Consequently, even if sets of recording media, in which recording media having a different size are mixed, are output, the sheet alignment capability can be enhanced.

Furthermore, in the recording medium output apparatus according to the present invention, it is acceptable that when the drive unit moves the output unit in the recording medium width direction, the higher the height position of the uppermost recording medium on the stack tray is, the longer distance the drive unit moves the output unit from the time at which the drive unit begins to move the output unit to the time at which the trail edge of the recording medium leaves the output unit. Alternatively, it is acceptable that the higher the height position of the uppermost recording medium on the stack tray is, at the higher speed the drive unit moves the output unit.

Still furthermore, the recording medium output apparatus according to the present invention may include a height position sensor that detects the height position of the uppermost recording medium on the stack tray, and the drive unit may move the output unit based on the height position as a result of detection executed by the height position sensor.

According to the present invention, the higher the height position of the uppermost recording medium on the stack tray 31 is, the shorter the falling distance of a recording medium to the stack tray is, and the shorter the falling distance is, the more the recording medium output from the output unit is unlike to fly obliquely forward. Accordingly, the amount of offset can be increased even in a recording medium having a short falling distance by making the recording medium having the short distance to be liable to fly obliquely forward. Note that when the height position sensor can continuously detect the height position, the moving speed of the output unit continuously changes, and when the height position sensor detects the height position stepwise, the moving speed of the output unit changes stepwise. However, the method of detecting the height position is not limited to the method of using the sensor. For example, the amount of offset can be increased even in a recording medium having a short falling distance by determining the height position of the uppermost recording medium based on the number of continuously output recording media.

The present invention also provides an image forming apparatus that transfers a toner image carried by an image carrier to a sheet-like recording medium and fixes the transferred toner image onto the recording medium so that the fixed toner image is formed on the recording medium, the apparatus including: a recording medium output apparatus that outputs the recording medium having the fixed toner image formed thereon and being transported onto a stack tray on which recording media are stacked. This recording medium output apparatus includes: (a) an output unit that is free to move in a recording medium width direction intersecting the transport direction of the recording medium being transported and outputs the recording medium toward the stack tray at a position higher than the stack tray; and (b) a drive unit that moves the output unit in the recording medium width direction before and after the trail edge of the recording medium, which is to be output from the output unit, leaves the output unit.

The foregoing description of the embodiment of the present invention has been provided for the purposes of illustration and description. It is not intended to be exhaustive or to limit the invention to the precise forms disclosed. Obviously, many modifications and variations will be apparent to practitioners skilled in the art. The embodiment was chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

The entire disclosure of Japanese Patent Application No. 2004-351120 filed on Dec. 3, 2004 including specification, claims, drawings and abstract is incorporated herein by reference in its entirety.

What is claimed is:

1. A recording medium output apparatus that outputs a sheet-like recording medium being transported onto a stack tray on which recording media are stacked, comprising:

an output unit that is free to move in a recording medium width direction intersecting the transport direction of the recording medium being transported and outputs the recording medium toward the stack tray at a position higher than the stack tray; and a drive unit that moves the output unit in the recording medium width direction before and after a trail edge of the recording medium, which is to be output from the output unit, leaves the output unit, wherein the drive unit drives the output unit as to cause the output unit to change a distance traveled by the recording medium in the recording medium width direction from a time when the trail edge of the recording medium leaves the output section to a time when the trail edge of the recording medium lands on the stack tray according to a size of the recording medium, a type of the recording medium, or a height position of the uppermost recording medium on the stack tray.

2. The recording medium output apparatus according to claim 1, wherein while the drive unit is moving the output unit in the recording medium width direction, the trail edge of the recording medium nipped by the output unit is a free end.

3. The recording medium output apparatus according to claim 1, comprising a trail edge sensor that detects that the trail edge of the recording medium being transported to the output unit has passed, wherein the drive unit begins to move the output unit after a predetermined time passes in response to detection of the passing of the trail edge of the recording medium by the trail edge sensor.

4. The recording medium output apparatus according to claim 1, wherein:

the output unit outputs sheet-like recording media having different sizes; and when the drive unit moves the output unit in the recording medium width direction, the smaller the size of the recording medium is, the longer distance the drive unit moves the output unit from the time at which the drive unit begins to move the output unit to the time at which the trail edge of the recording medium leaves the output unit.

5. The recording medium output apparatus according to claim 1, wherein:

the output unit outputs sheet-like recording media having different sizes; and when the drive unit moves the output unit in the recording medium width direction, the smaller the size of the recording medium is, at a higher speed the drive unit moves the output unit.

6. The recording medium output apparatus according to claim 1, wherein:

the output unit outputs sheet-like recording media having different weights per unit area; and when the drive unit moves the output unit in the recording medium width direction, the larger the weight per unit area of the recording medium is, the longer distance the drive unit moves the output unit from the time at which the drive unit begins to move the output unit to the time at which the trail edge of the recording medium leaves the output unit.

7. The recording medium output apparatus according to claim 1, wherein:

the output unit outputs sheet-like recording media having different weights per unit area; and when the drive unit moves the output unit in the recording medium width direction, the larger the weight per unit area of the recording medium is, at a higher speed the drive unit moves the output unit.

8. The recording medium output apparatus according to claim 1, wherein when the drive unit moves the output unit in the recording medium width direction, the higher the height position of the uppermost recording medium on the stack tray is, the longer distance the drive unit moves the output unit from the time at which the drive unit begins to move the output unit to the time at which the trail edge of the recording medium leaves the output unit.

9. The recording medium output apparatus according to claim 1, wherein when the drive unit moves the output unit in the recording medium width direction, the higher the height position of the uppermost recording medium on the stack tray is, at a higher speed the drive unit moves the output unit.

10. The recording medium output apparatus according to claim 8, comprising a height position sensor that detects the height position of the uppermost recording medium on the stack tray, wherein the drive unit moves the output unit based on the height position as a result of detection executed by the height position sensor.

11. The recording medium output apparatus according to claim 9, comprising a height position sensor that detects the height position of the uppermost recording medium on the stack tray, wherein the drive unit moves the output unit based on the height position as a result of detection executed by the height position sensor.

12. The recording medium output apparatus according to claim 8, comprising an output number counter that counts the number of output recording media, wherein the drive unit moves the output unit based on the height position determined by the number of the output recording media counted by the output number counter.

13. The recording medium output apparatus according to claim 9, comprising an output number counter that counts the number of output recording media, wherein the drive unit moves the output unit based on the height position determined by the number of the output recording media counted by the output number counter.

14. A recording medium output apparatus, comprising:

a rotation shaft that is perpendicular to a transport direction of a recording medium and free to move in a recording medium width direction;

at least a pair of rotation members, one of which is attached to the rotation shaft, rotate in the transport direction of the recording medium, and nips the recording medium; and a drive unit that drives the rotation shaft and the rotation members by synchronizing the movement of the rotation shaft with the rotation of the rotation members to cause the recording medium to be released from the rotation members nipping the same while the rotation shaft is moving in the recording medium width, wherein the drive unit drives the output unit as to cause the output unit to change a distance traveled by the recording medium in the recording medium width direction from a time when a trail edge of the recording medium leaves the output section to a time when the trail edge of the recording medium lands on the stack tray according to a size of the recording medium, a type of the recording medium, or a height position of the uppermost recording medium on a stack tray.

15. The recording medium output apparatus according to claim 14, wherein the trail edge of the recording medium nipped by the rotation members is a free end while the drive unit is driving the rotation shaft and the rotation members by synchronizing the movement of the rotation shaft with the rotation of the rotation members.

16. A recording medium output apparatus, comprising:

a first roller pair that transports a recording medium;

a second roller pair that can move in a recording medium width direction intersecting a recording medium transport direction, nip the recording medium transported by the first roller pair and rotate in the recording medium transport direction; and a controller that controls the drive of the second roller pair, wherein after the recording medium exits the first roller pair, the controller controls the drive of the second roller pair to cause the second roller pair to move in the recording medium width direction and to cause the recording medium nipped by the second roller pair to be released therefrom while a rotation shaft of the second roller pair is moving, wherein the controller drives the second roller pair as to cause the second roller pair to change a distance traveled by the recording medium in the recording medium width direction from a time when a trail edge of the recording medium leaves the second roller pair to a time when the trail edge of the recording medium lands on the stack tray according to a size of the recording medium, a type of the recording medium, or a height position of the uppermost recording medium on a stack tray.

17. An image forming apparatus that transfers a toner image carried by an image carrier to a sheet-like recording medium and fixes the transferred toner image onto the recording medium so that the fixed toner image is formed on the recording medium, the image forming apparatus comprising:

a recording medium output apparatus that outputs the recording medium having the fixed toner image formed thereon and being transported onto a stack tray on which recording media are stacked, wherein the recording medium output apparatus includes:

(a) an output unit that is free to move in a recording medium width direction intersecting the transport direction of the recording medium being transported and outputs the recording medium toward the stack tray at a position higher than the stack tray; and (b) a drive unit that moves the output unit in the recording medium width direction before and after the trail edge of the recording medium, which is to be output from the output unit, leaves the output unit, wherein the drive unit drives the output unit as to cause the output unit to change a distance traveled by the recording medium in the recording medium width direction from a time when a trail edge of the recording medium leaves the output section to a time when the trail edge of the recording medium lands on the stack tray according to a size of the recording medium, a type of the recording medium, or a height position of the uppermost recording medium on the stack tray.

* * * * *